United States Patent [19]

Coon et al.

[11] 4,000,432

[45] Dec. 28, 1976

[54] MAGNETIC SHIELD FOR IMAGE INTENSIFIER TUBE

[75] Inventors: Warren P. Coon, Cupertino; Elisha B. Merritt, Sunnyvale, both of Calif.

[73] Assignee: Varian Associates, Palo Alto, Calif.

[22] Filed: July 25, 1975

[21] Appl. No.: 599,272

[52] U.S. Cl. ..... 313/242; 313/239; 313/313; 313/94; 315/85; 250/213 VT

[51] Int. Cl.[2] ..... H01J 1/52

[58] Field of Search ..... 313/239, 242, 240, 313, 313/94; 315/85; 250/213 TV

[56] References Cited

UNITED STATES PATENTS

| | | | |
|---|---|---|---|
| 3,026,437 | 3/1962 | Niklas | 313/94 |
| 3,577,027 | 5/1971 | Szegho | 313/313 |
| 3,688,146 | 8/1972 | Bouwers | 313/313 |
| 3,858,050 | 12/1974 | Carlson | 313/313 |

FOREIGN PATENTS OR APPLICATIONS

| | | | |
|---|---|---|---|
| 802,960 | 10/1958 | United Kingdom | 313/94 |

OTHER PUBLICATIONS

"CRT Mounting System," by Swenson, IBM Technical Disclosure Bulletin, vol. 14, No. 1, June, 1971, p. 146.

*Primary Examiner*—Saxfield Chatmon, Jr.
*Attorney, Agent, or Firm*—Stanley Z. Cole; Richard B. Nelson; Robert K. Stoddard

[57] ABSTRACT

Intensifier tubes for x-rays or low-light levels form an image of photoelectrons which is focused on a fluorescent viewing screen. Stray magnetic fields, including the earth's field, bend the electron trajectories and distort the image. Magnetic shielding has been used around the tube, leaving the image-receiving end open. Magnetic field leaking through the open end is reduced by extending the end of the shield around the image-receiving aperture inward and forward of the edge of the tube.

5 Claims, 10 Drawing Figures

FIG. 1
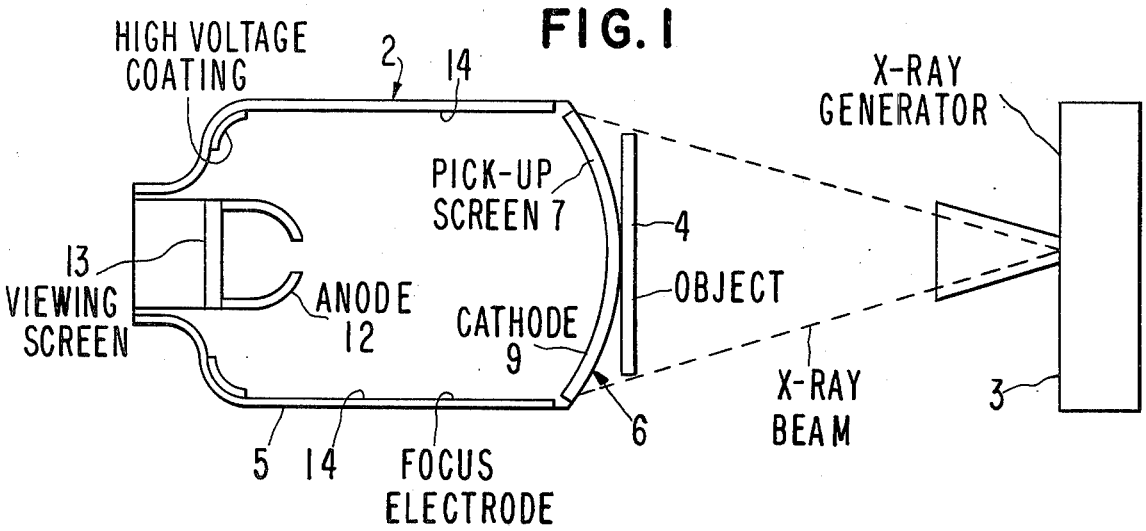
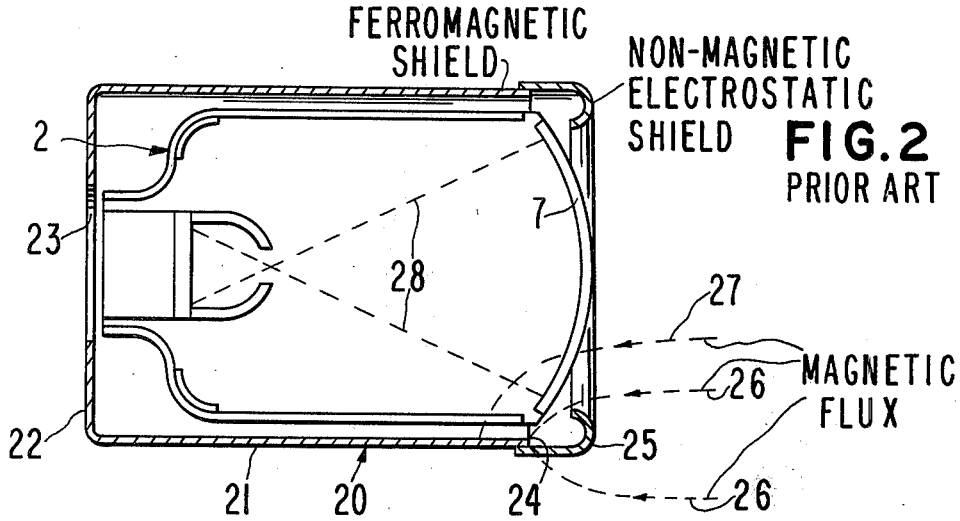
FIG. 2
PRIOR ART
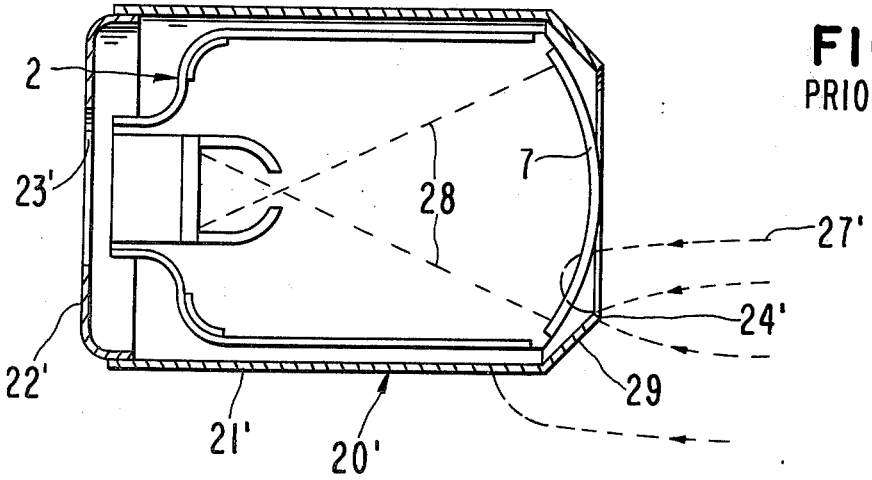
FIG. 3
PRIOR ART

MAGNETIC SHIELD FOR IMAGE INTENSIFIER TUBE

BACKGROUND OF THE INVENTION

1. Field of the Invention

This invention pertains to tubes which intensify electromagnetic radiation images, such as X-ray, infra-red or low light level images.

The tubes concerned convert the image to a corresponding image of photoelectrons which are accelerated and focused on a receiving screen, such as a cathodoluminescent phosphor. Stray magnetic fields in the tube produced by other equipment or the earth's field bend the electron trajectories and distort the image. Shielding against stray fields is beneficial.

2. Description of the Prior Art

Magnetic shielding of devices which depend on the trajectories of free electrons is well known in the art. U.S. Pat. No. 2,797,408 issued June 25, 1957 to W. H. Greatbatch, Jr. et al describes a ferromagnetic shield for a cathode-ray tube. U.S. Pat. No. 2,234,281 issued Mar. 11, 1941 to E. Ruska discloses internal shielding in an electron microscope.

In image intensifier tubes concerned with the present invention the shielding problem is acute because the shield must have an aperture for the received photon image. Stray magnetic field leaking in through the aperture reaches the photocathode end of the tube where the electrons are going slowly and hence are most susceptible to magnetic deflection. Prior art schemes have tried to compensate for the image distortion by adding magnet coils in which the current is adjusted to balance out the stray fields. U.S. Pat. No. 3,809,889 issued May. 7, 1974 to Robert C. McBroom discloses a balancing coil scheme. These schemes are of limited benefit because when the external fields change or when the tube is moved the critical adjustment must be redone. Prior art passive shields of ferromagnetic material as shown in FIGS. 2 and 3 have had only limited success due to the patterns of field leaking in through the image aperture and distorted by the open edge of the shield, as described more fully below.

SUMMARY OF THE INVENTION

The purpose of the invention is to provide an improved magnetic shield for an image intensifier tube. This purpose is met by providing the end of the shield surrounding the input image aperture with a portion extending inwardly of the aperture to leave open only the needed aperture for the image. Also, the end portion extends forwardly of the image face of the tube in the direction towards the image source. This provides a short but effective tunnel section, which attentuates and distributes the stray fields to greatly reduce the residual fields at the electron trajectories.

BRIEF DESCRIPTION OF THE DRAWINGS

FIG. 1 shows a prior-art X-ray image intensifier system.

FIGS. 2 and 3 are axial cross sections of prior art magnetic shields.

DETAILED DESCRIPTION

Figure 4:
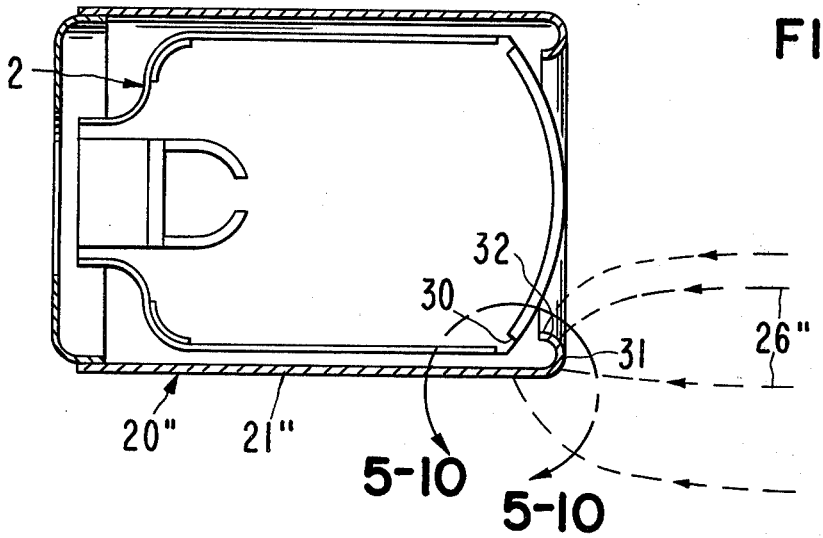
FIG. 4 is a cross section of a shield embodying the present invention.

FIG. 1 shows the type of image intensifier tube whose operation is improved by the present invention. The details of such tubes are well known, being described for example in an article entitled, "X-ray Image Intensification With a Large Diameter Image Intensifier Tube," appearing in the American Jnl. of Roentgenology Radium Therapy and Nuclear Medicine, vol 85, pp. 323–341 of February 1961. Briefly, an X-ray generator 3 serves to produce and direct the beam of X-rays onto an object 4 to be X-rayed. The image intensifier tube 2 is disposed to receive the X-ray image of the object 4.

The image itensifier tube 2 includes a dielectric vacuum envelope 5, as of glass, approximately 17 inches long and 10 inches in diameter. The image receiving face portion 6 of the tube 2 comprises a spherical X-ray transparent portion of the envelope 5, as of aluminum or conductively coated glass, which is operated at cathode potential. An image pickup screen 7 made of an X-ray sensitive scintillator such as an activated alkali metal halide, is deposited onto the inside spherical surface of the envelope portion to a thickness as of 0.003 inch. A photocathode layer 9 may be formed directly over the screen 7.

In operation, the X-rays penetrate the object 4 to be observed. The local X-ray attenuation depends on both the thickness and atomic number of the elements forming the object under observation. Thus, the intensity pattern in the X-ray beam after penetration of the object 4 contains information concerning the structure of the object. The X-ray image passes through the envelope section 6 and falls upon the X-ray sensitive scintillator layer 7 wherein the X-ray photons are absorbed and re-emitted as optical photons. The optical photons pass 8 to the photocathode 9 wherein they produce electrons. The electrons are emitted from the photocathode 9 in a pattern or image corresponding to the original X-ray image. The electrons are accelerated to a high velocity, as of 30 kv., within the tube 2 and are focused through an anode structure 12 onto a fluorescent screen 13 for viewing by the eye or other suitable optical pickup device. Electron focusing electrodes 14 are deposited on the interior surfaces of the tube to focus the electrons through the anode 12.

In the intensifier tube 2, one 50 kev. of X-ray energy absorbed by the X-ray sensitive scintillator screen 7 produces in the case of Na doped CsI about 2,000 photons of blue light. These 2,000 photons of blue light produce about 400 electrons when absorbed in the photocathode layer 9. The 400 electrons emitted from the photocathode produce about 400,000 photons of light in the visible band when absorbed by the fluorescent viewing screen 13. Thus, the X-ray image is converted to the visible range and greatly intensified for viewing.

FIG. 2 shows a prior-art shield 20 in the form of a figure of revolution to partially surround tube 2 which is essentially a figure of revolution. Shield 20 is formed of high-permeability ferrous metal such as sold under trade names of Mu-metal, Hymu 80, or Hypernom. Shield 20 consists of a cylinder 21 of sheet metal closed at the viewing end by a disc portion 22 with a central aperture 23 for viewing the intensified image. Other small apertures (not shown) conduct the electrical supply leads to tube 2. The image receiving end 24 of cylinder 21 is magnetically open. An electrostatic shield 25 of non-magnetic material has no effect on the magnetic properties. Lines of magnetic flux 26 are shown for example as if part of an axial, externally uniform field. Other directions of external field would be affected in an analogous manner. The open end 24 of cylinder 21 collects and concentrates the flux lines 26 at its sharp tip. Some flux 27 penetrates inside cylinder 21 before being diverted to it, passing through a portion of the space occupied by the trajectories 28 of the photoelectrons. The trajectories and the resulting image are thereby distorted.

FIG. 3 is a schematic section of another prior-art shield intended to reduce the field penetration. Here the image-receiving end of cylinder 21′ is tapered inward in a conical section 29 ending in an aperture 24′ just large enough to transmit the useful size of the input image. The smaller aperture 24′ was supposed to reduce the amount of stray flux penetrating from the external fields. However, the sharp tip of aperture 24′, having a depth of only the thickness of the shield material, in close proximity to image pickup screen 7, still concentrates some stray flux including flux lines 27′ passing through space occupied by electron trajectories 28. Near the tip, the local field may be quite intense.

FIG. 4 illustrates an embodiment of the present invention. Shield envelope cylinder 21″ has an end portion extending past the adjacent edge 30 of the input screen, then folded inward 31 to define an image iris and terminated in an edge portion 32 extending part way back toward the tube 2. Most of the external flux lines 26″ terminate on the forward extending portion of shield 20″ and the field inside tube 21″ is greatly reduced. Due to the depth of the forward extension, there is no sharp concentration of field anywhere inside tube 2. By folding the metal, the depth of the end portion is much greater than the thickness of the sheet.

Experimental measurements on a 9 inch image tube in an axial magnetic field showed that for an equivalent degradation of resolution the shield of FIG. 2 required 0.85 gauss of external field, the shield of FIG. 3 required 0.65 gauss, while the shield of the present invention as shown in FIG. 4 required 1.04 gauss. For equal external fields the shield of the present invention thus allows less distortion.

Applicant believes that the exact shape of shield 20 is not important, but that improved shielding is obtained by the combination of the image-input end extending inwardly to the edge of the optical aperture, as section 31, and also extending forward of the adjacent area of the screen, in the direction of the incident image 30, as section 32. Accordingly, many different mechanical structures come within the scope of the invention and can produce the desired result. FIGS. 5, 6, 7, 8 and 9 illustrate some embodiments.

Figure 5:
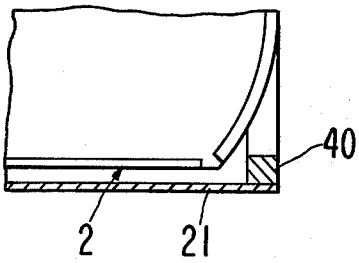
FIGS. 5, 6, 7, and 8 are cross sections of portions of alternate embodiments corresponding to the designated area of FIG. 4.

FIG. 5 shows a ring of solid magnetic shield material 40 joined, as by welding, inside the end of shield cylinder 21.

Figure 6:
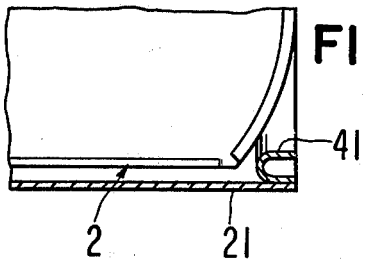
Figure 7:
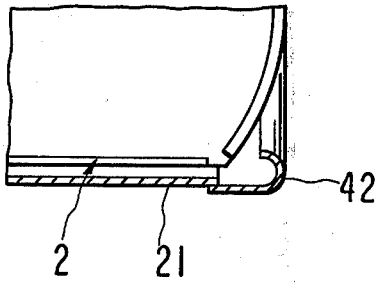
Figure 8:
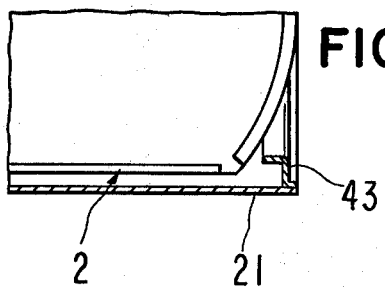

FIGS. 6, 7 and 8 show easily fabricated sheet metal shapes 41, 42 and 43 forming an extending edge of shield 20 and joined, as by welding, to envelope 21. These various shapes all provide a portion extending inwardly to define the aperture for the electromagnetic image and a portion extending in front of the image face to a depth larger than the sheet thickness.

Figure 9:
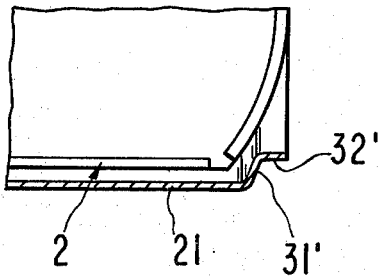

FIG. 9 shows an alternative shaping of the end of cylinder 21 to form an inward extension 31′ and an axial extension 32′.

Figure 10:
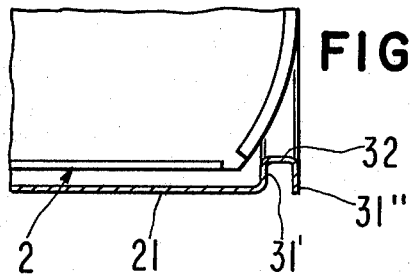

FIG. 10 shows a variation of FIG. 9 including a second radially extending portion 31″. The shapes of FIGS. 4, 9 and 10 avoid welding of parts, which may disturb the delicate properties of high-permeability materials.

Many other structural forms of the invention will be apparent to those skilled in the art, such as non-circular shapes and structures resulting from different fabrication process. The embodiments described are intended to be exemplary and not restrictive.

What is claimed is:

1. A shield of ferromagnetic material for a photoelectric image intensifier tube, said tube having an image-receiving face, said shield comprising: an envelope portion of sheet material shaped to partially surround said tube, and an end portion extending inwardly from said envelope portion to form an aperture forward of said image-receiving face of said tube, said end portion extending forward of the adjacent area of said face to a depth large compared to the thickness of said sheet material.

2. The shield of claim 1 wherein said end portion is formed of a sheet of ferromagnetic metal.

3. The shield of claim 2 wherein said end portion is an integral extension of said envelope sheet.

4. The shield of claim 2 wherein said end portion is formed to extend from said envelope portion forward of said adjacent area of said face, then inward to define said aperture, then backward toward said face.

5. The shield of claim 1 wherein said shield is substantially a figure of revolution about the axis of said tube.

* * * * *